US007637184B2

(12) United States Patent
Moon et al.

(10) Patent No.: US 7,637,184 B2
(45) Date of Patent: Dec. 29, 2009

(54) LOCKING/UNLOCKING DEVICE FOR DUST-COLLECTOR AND UPRIGHT VACUUM CLEANER HAVING THE SAME

(75) Inventors: Joo-sung Moon, Seoul (KR); Dong-hun Yoo, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 503 days.

(21) Appl. No.: 11/349,639

(22) Filed: Feb. 8, 2006

(65) Prior Publication Data

US 2007/0011842 A1 Jan. 18, 2007

Related U.S. Application Data

(60) Provisional application No. 60/698,391, filed on Jul. 12, 2005.

(30) Foreign Application Priority Data

Aug. 19, 2005 (KR) ..... 10-2005-0076485

(51) Int. Cl.
*A47L 5/10* (2006.01)
*A47L 5/26* (2006.01)

(52) U.S. Cl. ..... 81/352; 81/353; 81/350; 81/351

(58) Field of Classification Search ..... 15/352, 15/353, 351, 350
See application file for complete search history.

(56) References Cited

U.S. PATENT DOCUMENTS

| | | | | |
|---|---|---|---|---|
| 3,097,673 | A | 7/1963 | Hunt | 141/272 |
| 6,095,363 | A * | 8/2000 | Harris et al. | 220/203.26 |
| 6,385,810 | B1 * | 5/2002 | Lang | 15/352 |
| 6,735,816 | B2 | 5/2004 | Oh et al. | 15/353 |
| 2005/0138761 | A1 | 6/2005 | Park et al. | 15/352 |

FOREIGN PATENT DOCUMENTS

GB 2 365 325 A 2/2002

* cited by examiner

*Primary Examiner*—Joseph J Hail, III
*Assistant Examiner*—Shantese McDonald
(74) *Attorney, Agent, or Firm*—Ohlandt, Greeley, Ruggiero & Perle, L.L.P.

(57) ABSTRACT

A dust-collector locking/unlocking device to lock or unlock a dust-collector removably mounted in a cleaner body. The dust-collector locking/unlocking the device includes a first member and a second member connected with a lower portion of the first member and serving as a cover for the dust-collector. The first member includes a first hook that is rotatably connected with an upper wall of the cleaner body, a manipulation lever that protrudes from an outer circumference of the first member for rotation of the first member by a user, and first cam parts formed on a lower portion of the first member. The second member includes a second hook movably connected with guide cams formed on the first member, and second cam parts engaged with the first camp part. The second member is moved up and down by the rotational movement of the manipulation lever and thereby lock or unlock the dust-collector.

4 Claims, 7 Drawing Sheets

LOCKING/UNLOCKING DEVICE FOR DUST-COLLECTOR AND UPRIGHT VACUUM CLEANER HAVING THE SAME

CROSS REFERENCE TO RELATED APPLICATIONS

This application claims the benefit of U.S. Provisional Application Ser. No. 60/698,391, filed Jul. 12, 2005 and claims the benefit under 35 U.S.C. § 119(a) of Korean Patent Application No. 2005-76485, filed Aug. 19, 2005, the contents of both of which are incorporated by reference herein.

BACKGROUND OF THE INVENTION

1. Field of the Invention

The present invention relates to an upright vacuum cleaner. More particularly, the present invention relates to a locking/unlocking device for a dust-collector that is removably mounted in an upright vacuum cleaner, and an upright vacuum cleaner having the same.

2. Description of the Related Art

An upright vacuum cleaner comprises a cleaner body having a motor as a vacuum generating source, a suction nozzle disposed under the cleaner body to draw in dust-laden air therethrough, a dust-collector to separate dust particles from the air drawn in through the suction nozzle, collect the separated dust particles and discharge a cleaned air to the outside.

The dust-collector is removably mounted in a mounting portion of the cleaner body. A user removes the dust-collector from the cleaner body to empty the dust-collector or repair the cleaner body. Meanwhile, when the vacuum cleaner cleans a large cleaning area, the dust-collector must be securely mounted in the cleaner body to be able to perform a cleaning operation smoothly. Therefore, a locking/unlocking device for the dust-collector is necessarily required.

The conventional dust-collector is secured to the cleaner body by a screw. However, an extra tool is required to dismount the dust-collector from the cleaner body, and it takes a large amount of time to drive or extract the screw. Therefore, a current upright vacuum cleaner has a lever formed on a cleaner body that can be simply operated to lock or unlock the dust-collector.

U.S. Pat. No. 6,385,810 (the '810 patent) discloses a lever 124 pivotably disposed at an upper wall of a dirt cup chamber and a latch plate 100 pivoting vertically in cooperation with a cam groove 126 formed on a body of the lever 124 when the lever 124 pivots. By pivoting the lever 124 from left to right and right to left, the latch plate 100 is moved downward and upward and thereby latches and unlatches a dirt cup 10.

However, the locking/unlocking device disclosed in the '810 patent has a very complicated structure. Also, a cam sleeve 102 is additional required to pivotably secure the lever 124 to an upper wall of the dirt cup chamber. Due to the complicated structure, a manufacturing cost is inevitably increased.

U.S. Pat. No. 6,735,816 (the '816 patent) discloses an operating lever 410 pivotably disposed at a lower wall of a dust-collecting chamber and a locking disk 420 pivotably connected with an upper portion of the operating lever 410. The operating lever 410 and the locking disk 420 have cams 460, 470, respectively, such that the locking disk 420 is moved vertically as the operating lever pivots, and thereby locks or unlocks the dust-collecting chamber.

However, the '816 patent further discloses a suction passage 210 and a discharging passage 220 disposed at a side or an upper portion of the dust-collecting chamber. Therefore, tubes 140, 150 fluidly communicating with the suction passage 210 and the discharging passage 220 inevitably become elongated. In an attempt to solve this problem, an upright vacuum cleaner has a suction passage and a discharging passage formed in a bottom of a dust-collector and thus has an air channel shortened. However, according to the '816 patent, since the operating lever 410 and the locking disk 420 are disposed on the lower wall of the dust-collecting chamber, it is difficult to dispose the suction passage and the discharging passage on the lower surface of the dust-collecting chamber.

SUMMARY OF THE INVENTION

The present invention has been developed in order to solve these and/or other problems in the related art. An aspect of the present invention is to provide a dust-collector locking/unlocking device having a simplified and compact structure, and an upright vacuum cleaner having the same.

The above aspect is achieved by providing a dust-collector locking/unlocking device to lock or unlock a dust-collector removably mounted in a cleaner body. The dust-collector locking/unlocking device includes a first member having a first hook that is rotatably connected with the cleaner body, a manipulation lever that protrudes from an outer circumference of the first member so that the first member is rotatable by a user, and a second member disposed under the first member and having a second hook movably connected with guide cams formed on the first member. Preferably, but not necessarily, the second member is a cover of the dust-collector.

Preferably, but not necessarily, the first member further includes first cam parts formed on the lowest surface of the first member, and the second member further includes second cam parts having a shape to be engaged with the first cam parts.

Preferably, but not necessarily, the second member further includes a fixing protrusion that is connected with the cleaner body and is movable up and down.

Preferably, but not necessarily, the first member further includes a first penetrating hole and a second penetrating hole through which the second hook and the fixing protrusion of the second member penetrate, respectively.

The above aspects are also achieved by providing an upright vacuum cleaner including a cleaner body having a motor driving chamber, a suction nozzle connected with a lower portion of the cleaner body, a dust-collector removably mounted in the cleaner body, and a dust-collector locking/unlocking device to lock or unlock the dust-collector with respect to the cleaner body, the dust-collector locking/unlocking device comprising a first member rotatably connected with the cleaner body and having a manipulation lever, and a second member movably connected with a lower portion of the first member, wherein the second member moves up and down in cooperation with a cam movement of the first member when the manipulation lever is rotated, thereby locking or unlocking the dust-collector, and the second cover is a cover of the dust-collector.

Preferably, but not necessarily, the first member includes a first hook connected with an upper wall of the cleaner body, and first cam parts formed on a lower end of the first member, and wherein the second member includes a second hook movably connected with guide cams formed on the first member, second cam parts engaged with the first cam parts, and a fixing protrusion connected with the upper wall of the cleaner body and movable vertically.

BRIEF DESCRIPTION OF THE DRAWINGS

These and/or other aspects of the present invention will become apparent and more readily appreciated from the following description of the embodiment, taken in conjunction with the accompanying drawings of which.

DETAILED DESCRIPTION OF AN EXEMPLARY EMBODIMENT

Hereinafter, a dust-collector locking/unlocking device and an upright vacuum cleaner having the same according to an embodiment of the present invention will now be described with reference to the accompanying drawings.

Figure 1:
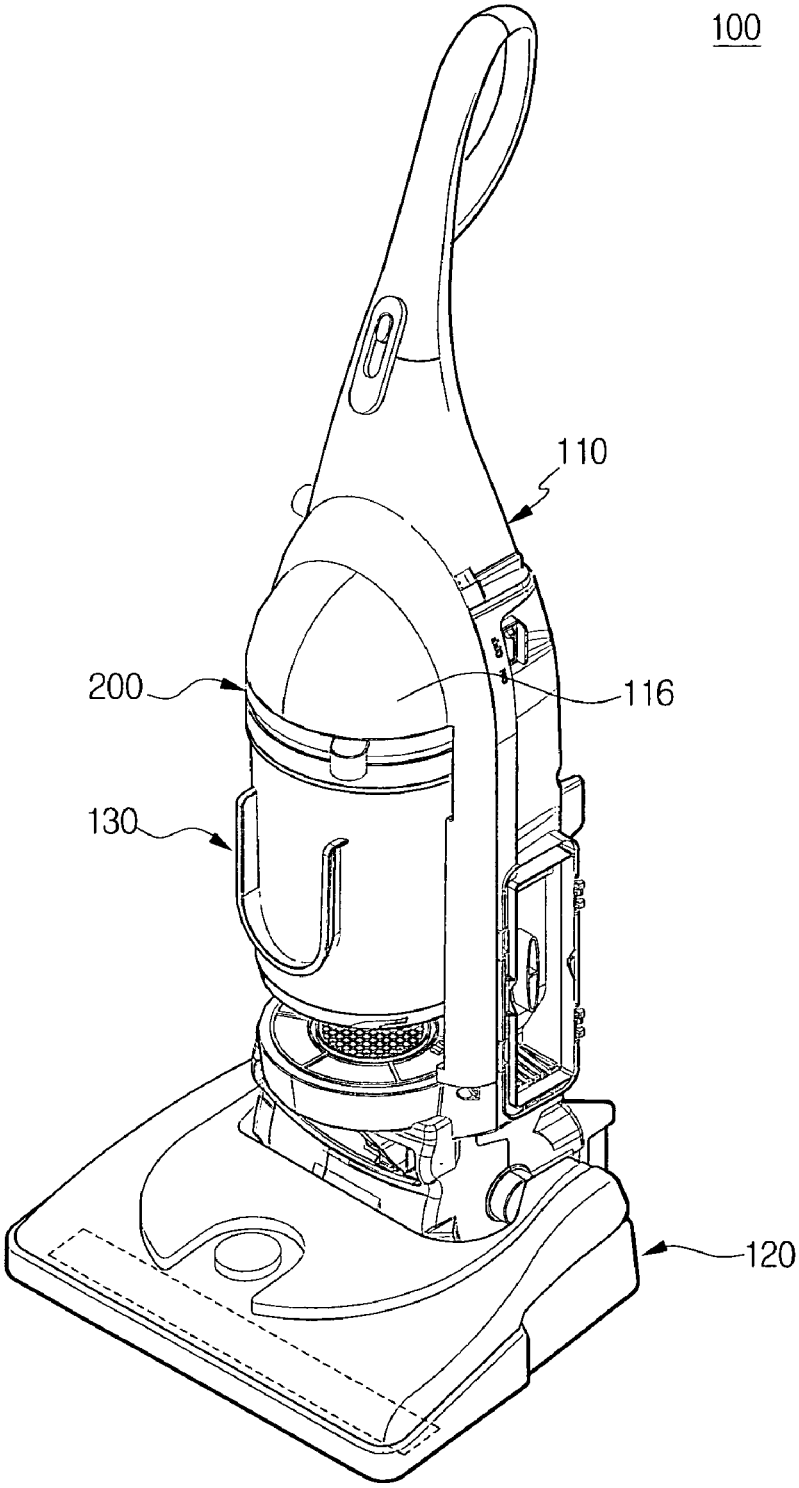
FIG. 1 is a perspective view illustrating appearance of an upright vacuum cleaner employing a dust-collector locking/unlocking device according to an embodiment of the present invention.

FIG. 1 is a perspective view illustrating the appearance of an upright vacuum cleaner employing a dust-collector locking/unlocking device according to an embodiment of the present invention. Referring to FIG. 1, an upright vacuum cleaner 100 comprises a cleaner body 110 having a motor driving chamber (not shown) as a vacuum generation source, a suction nozzle 120 disposed under the cleaner body 110 to draw in dust-laden air, a dust-collector 130 removably mounted in the cleaner body 110, and a dust-collector locking/unlocking device 200 to lock/unlock the dust-collector 130 to/from the cleaner body 110.

The dust-laden air drawn in through the suction nozzle 120 flows into the dust-collector 130 through an inflow channel (not shown) disposed in the cleaner body 110. The dust-collector 130 separates dust particles from the air and collects the separated dust particles therein. Filtered air is discharged from the cleaner body 110. When the dust-collector 130 becomes full, it has to be removed from the cleaner body 110 and emptied. Before the next cleaning operation, the emptied dust-collector 130 is re-mounted in the cleaner body 110. The dust-collector 130 comprises a cyclone separator (not shown) to separate dust particles from the air using a centrifugal force, a dust receptacle (not shown) to collect the dirt particles, and a cover (not shown). Depending on the specification of the dust-collector or the vacuum cleaner, the cyclone separator may be fixed to the cleaner body and only the dust receptacle may be removable from the cleaner body 110.

Figure 4:
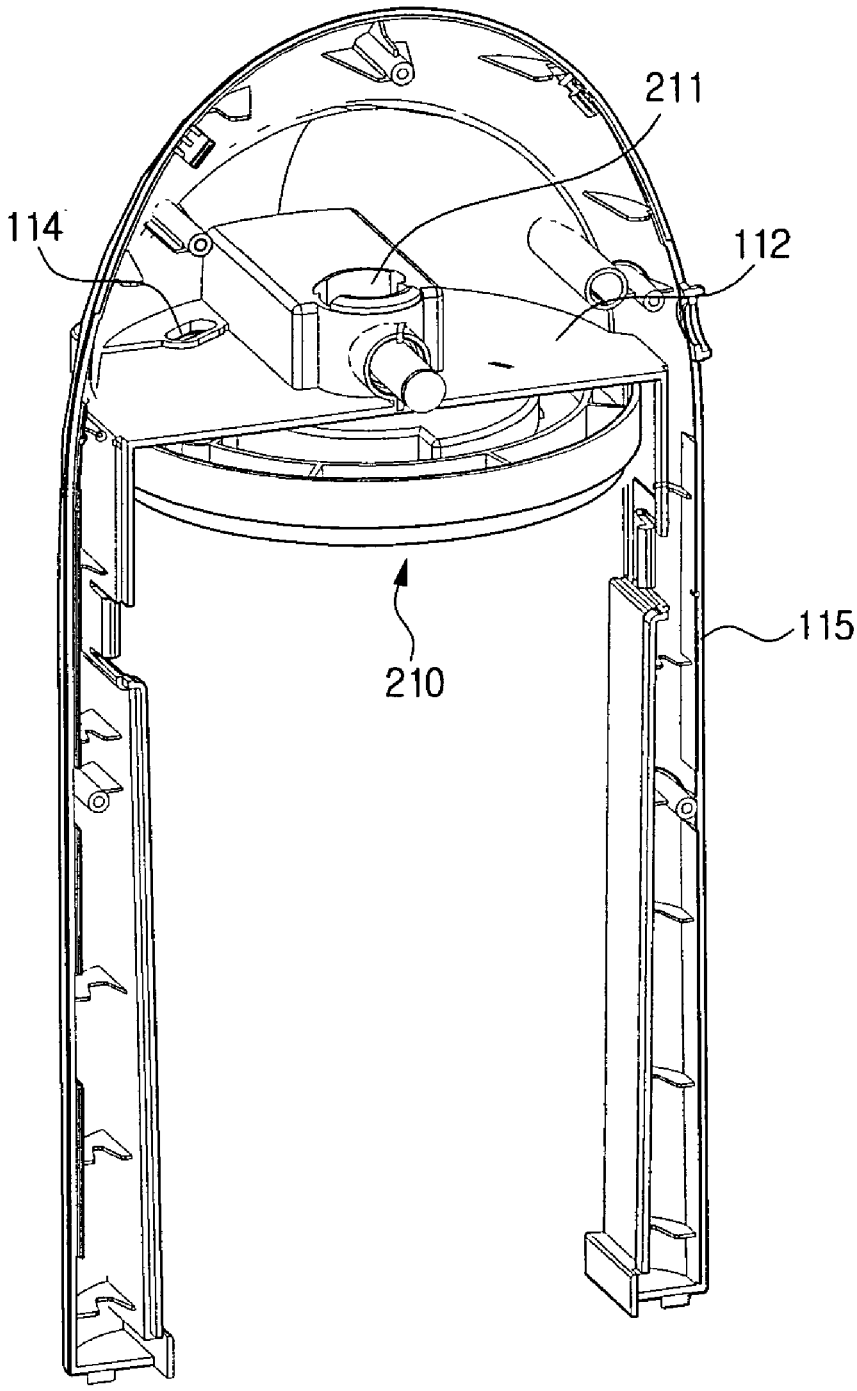
FIG. 4 is a perspective view illustrating the first member of the dust-collector locking/unlocking device of FIG. 2 assembled with a cleaner body.

The cleaner body 110 comprises a front frame cover 116 having a front frame 115 (FIG. 4).

Figure 2:
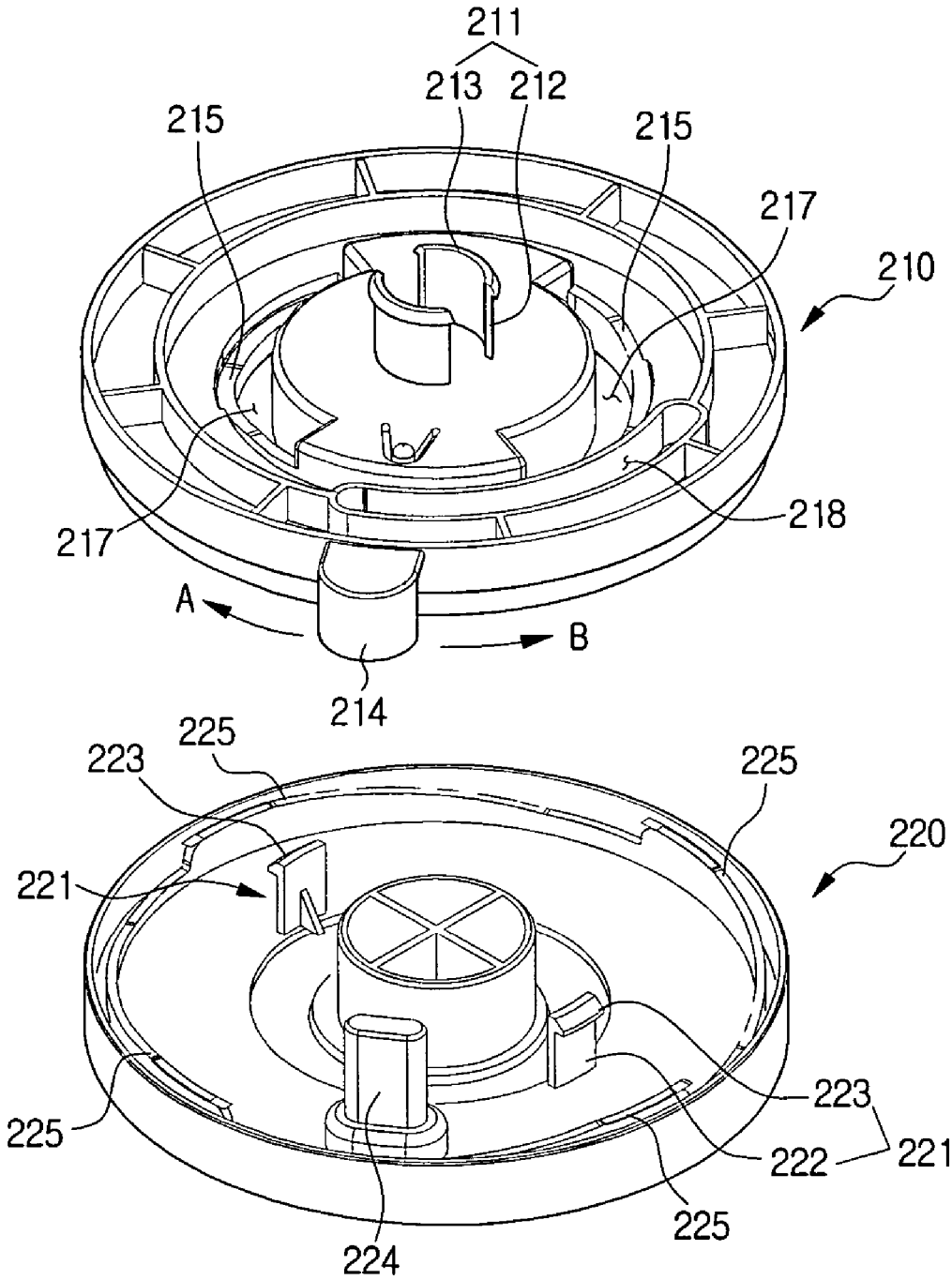
FIG. 2 is an exploded perspective view illustrating the dust-collector locking/unlocking device according to an embodiment of the present invention.
Figure 3:
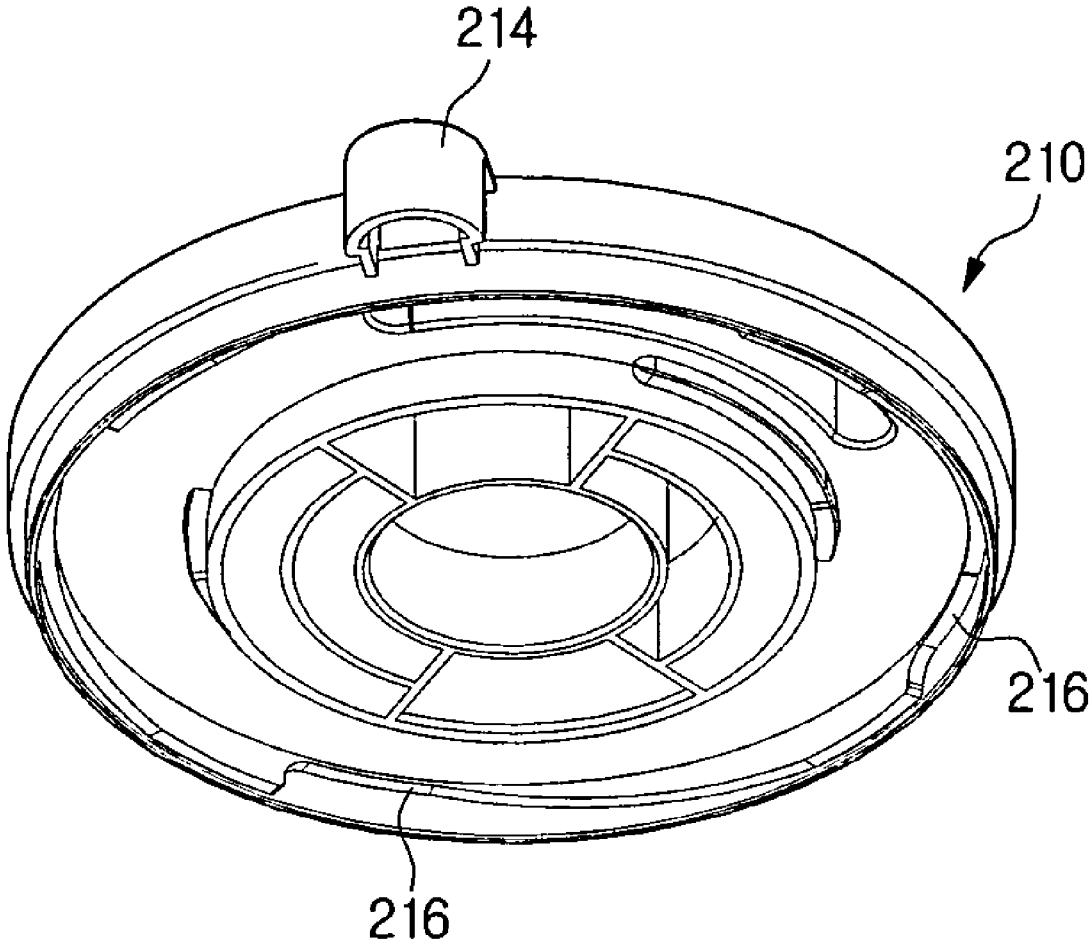
FIG. 3 is a bottom view illustrating a first member of the dust-collector locking/unlocking device of FIG. 2.
Figure 5:
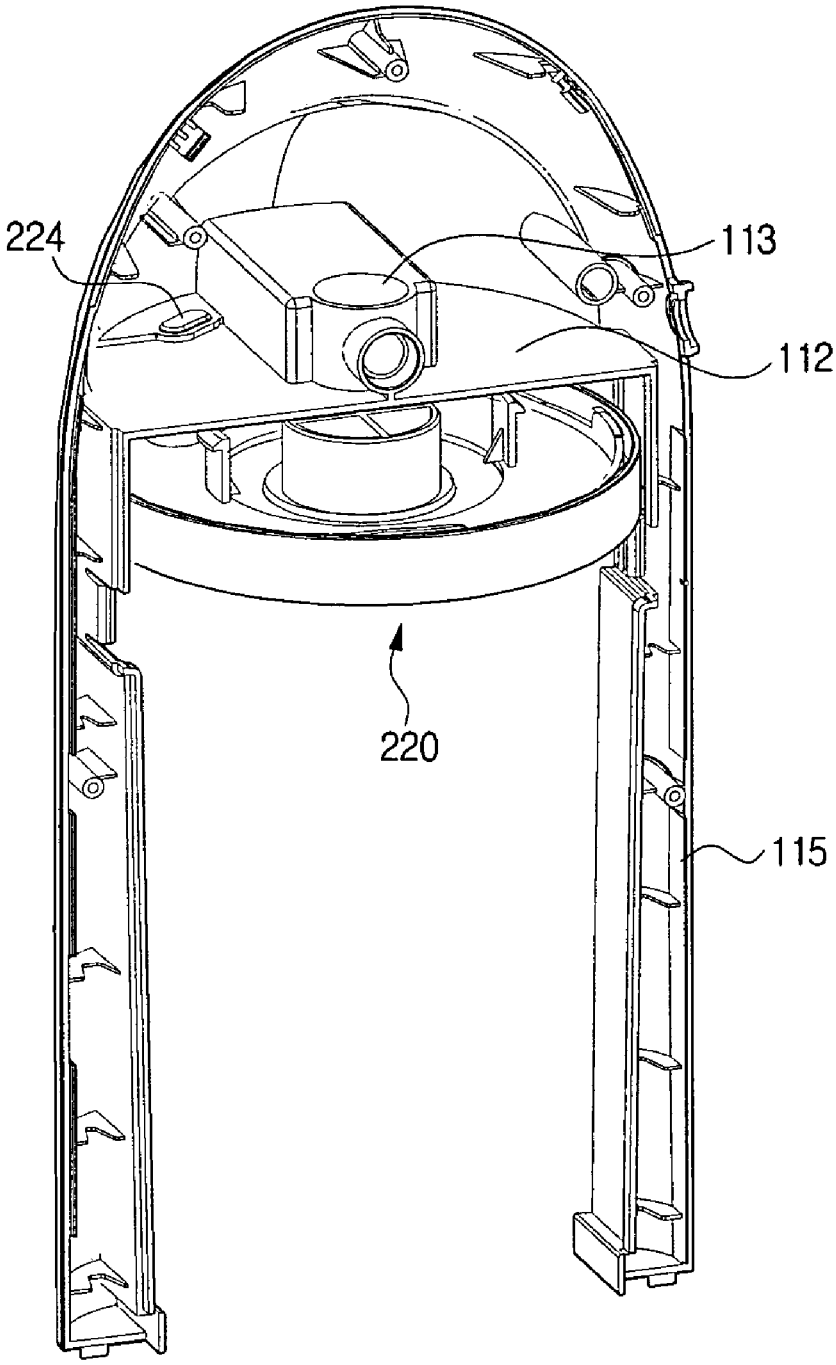
FIG. 5 is a perspective view illustrating a second member of the dust-collector locking/unlocking device of FIG. 2 assembled with the cleaner body.

The dust-collector locking/unlocking device 200 is disposed on the cleaner body 110 to lock/unlock the dust-collector 130 with respect the cleaner body 110. FIG. 2 is an exploded perspective view illustrating the dust-collector locking/unlocking device 200. As shown in FIG. 2, the dust-collector locking/unlocking device 200 comprises a first member 210 and a second member 220 disposed under the first member 210 and removably connected with the same. FIG. 3 is a bottom view of the first member 210 of FIG. 2, and FIG. 4 is a perspective view illustrating the first member 210 of FIG. 2 connected to an upper wall 112 of the front frame 115. FIG. 5 is a perspective view illustrating the second member 220 of FIG. 2 connected to the upper wall 112 of the front frame 115. FIGS. 4 and 5 do not illustrate the front frame cover 116 (see FIG. 1) for the convenience of explanation.

As shown in FIGS. 2 and 3, the first member 210 comprises a first hook 211 rotatably connected with the upper wall 112 of the front frame 115, a manipulation lever 214 protruding from an outer circumference of the first member 210 for a user manipulation, guide cams 215, and first cam parts 216.

The first hook 211 upwardly protrudes from the center of the first member 210 towards the upper wall 112 of the front frame 115, and is rotatably positioned in a mounting hole 113 formed in the upper wall 112 (see FIGS. 4 and 5). The first hook 211 comprises a pair of body parts 212 penetrating through the mounting hole 113 and a hook part 213 depending from each body part 212. The body parts 212 resiliently depend from first member 210 so that the first hook 211 can be biased inward toward one another while hook parts 213 are inserted into mounting hole 113, but can bias outward from one another so that hook parts 213 are hooked onto an upper end of the mounting hole 113. The first hook 211 servers as a rotation axis for the first member 210 within mounting hole 113. The first member 210 is hung to the upper wall 112 of the cleaner body 110 by the first hook 211, and it is rotatable on the first hook 211 but not movable vertically. Accordingly, if a user moves the manipulation lever 214 in the arrow direction A or B, the first member 210 is rotated on the first hook 211 in the direction A or B.

Figure 7:
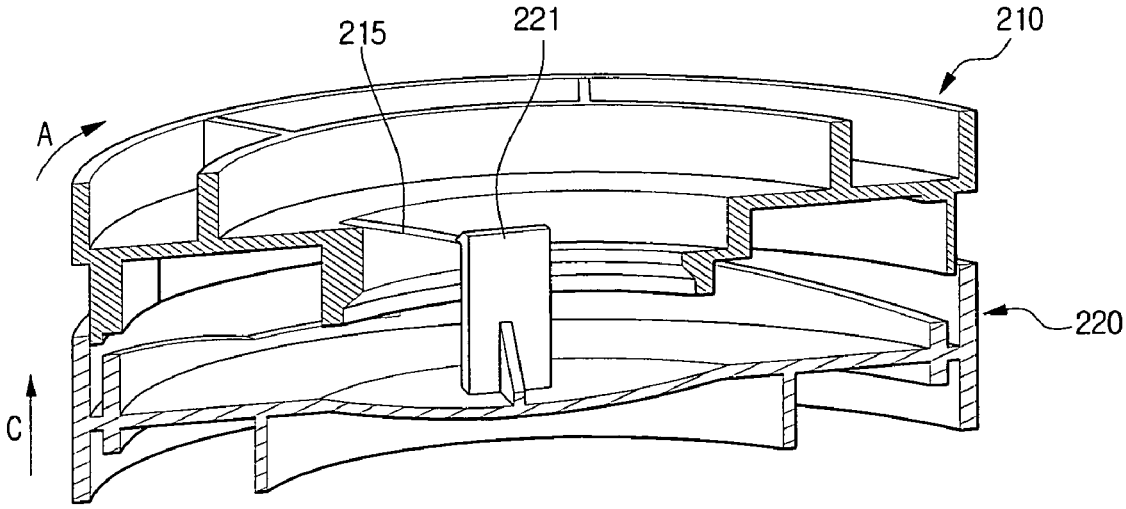
FIGS. 7 and 8 are enlarged views of FIG. 6 as viewed from the different direction, for explaining operation of the dust-collector locking/unlocking device according to an embodiment of the present invention.

The guide cams 215 are hooked by second hooks 221 of the second member 220, and, as shown in FIGS. 2 and 7, the guide cams 215 are upwardly inclined in one direction. Accordingly, when the first member 210 is moved in the direction A, the second hooks 221 slide upwardly along the guide cams 215. As a result, the second member 220 is moved upwardly, i.e., in the direction C of FIG. 7.

The first cam parts 216 are formed on the lowest surface of the first member 210 and have a shape corresponding to second cam parts 225 of the second member 220. More specifically, as shown in FIG. 3, the first cam parts 216 are downwardly inclined in the direction B, whereas the second cam parts 225 are upwardly inclined in the direction B. If the manipulation lever 214 is moved in the direction B, the first cam parts 216 are engaged with the second cam parts 225, thereby downwardly pressing the second cam parts 225. Accordingly, the second member 220 is moved downwardly and thereby securely locks the dust-collector 130 (see FIG. 1).

The first member 210 has a pair of first penetrating holes 217 and a second penetrating hole 218 to pass the second hooks 221 and a fixing protrusion 224 therethrough, respectively.

The second member 220 comprises the second hooks 221 movably hooked onto the guide cams 215, the second cam parts 225 engaged with the first cam parts 216 of the first member 210, and the fixing protrusion 224 fixed to the upper wall 112 of the front frame 115.

The second hooks 221 upwardly protrude from the bottom of the second member 220, and each comprise a body part 222 passing through the first penetrating holes 217 of the first member 210 and hook parts 223 hooked onto the guide cams 215. As described above, as the first member 210 is rotated in the direction A, the second hooks 221 upwardly slide along the guide cams 215 and consequently the second member 220 is moved upwardly, i.e., in the direction C (see FIG. 7).

The fixing protrusion 224 upwardly protrudes from the bottom of the second member 220 and is inserted into a fixing hole 114 of the upper wall 112 of the front frame 115 (see FIGS. 4 and 5). The fixing protrusion 224 is movable vertically with respect to the fixing hole 114. The second member 220 is rotatable horizontally in cooperation with the first member 210, but its rotational movement is restricted by the fixing protrusion 224 and the second penetrating hole, and thus the second member 220 maintains its rotational position within the length of the second penetrating hole.

Figure 8:
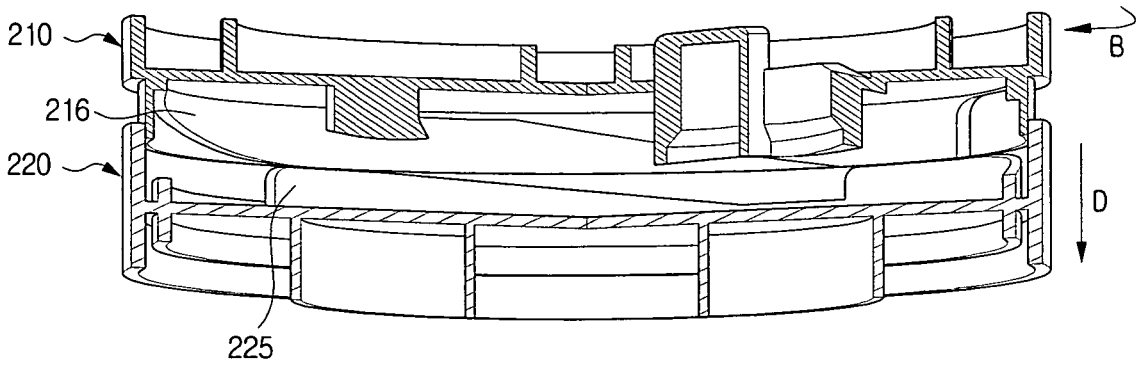

The second cam parts 225 are engaged with the first cam parts 216 of the first member 210. The second cam parts 225 are upwardly inclined in the direction B. As shown in FIG. 8, if the first member 210 is rotated in the direction B by manipulating the manipulation lever 214, the first and the second cam parts 216, 225 are brought into contact such that the first cam parts 216 downwardly presses the second cam parts 225. As a result, the second member 220 is moved downwardly in the direction D.

Since the dust-collector locking/unlocking device 200 is disposed on the upper portion of the dust-collector 130, there is no limitation to arrangements of a suction passage and a discharging passage of the dust-collector 130. In the conventional art, a suction passage and a discharging passage have to be disposed a side portion or an upper portion of a dust-collector, but according to the present invention, it is possible to dispose the suction passage and the discharging passage on the bottom of the dust-collector 130.

Preferably, the second member 220 servers as a cover to cover an upper portion of the dust-collector 130 (see FIG. 1). Since no additional cover is required to cover the dust collector 130, the volume of the dust-collector 130 can be reduced and also the vacuum cleaner employing the dust-collector 130 can be compact-sized.

Hereinafter, operation of the dust-collector locking/unlocking device 200 according to an embodiment of the present invention will now be described.

Figure 6:
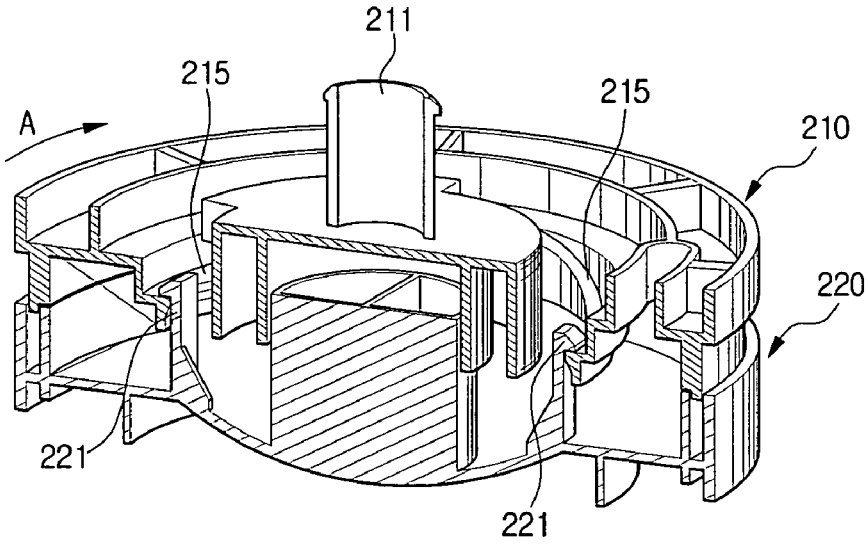
FIG. 6 is a partially cutaway perspective view illustrating the first and the second member in an assembled state.

As shown in FIGS. 6 and 7, a user rotates the manipulation lever 214 of the first member 210 in one direction, i.e., in the direction A to remove the dust-collector 130 from the cleaner body 110 to empty or repair the dust-collector 130. Rotation of the manipulation lever 214 in the direction A causes the first member 210 to be rotated on the first hook 211 in the direction A so that the second hooks 221 upwardly slide along the guide cams 215 causing the second member 220 to move upwardly in the direction C. At this time, the second member 220 is disjoined and separated from the upper end of the dust-collector 130 by a predetermined distance. To this end, a user easily removes the dust-collector 130 from the cleaner body 110 by simply holding and drawing out the dust-collector 130.

In order to re-mount the dust-collector 130 in the cleaner body 110 to perform a cleaning operation, as shown in FIG. 8, the user rotates the manipulation lever 214 in the opposite direction i.e., in the direction B. Rotation of the manipulation lever 214 in the direction A causes the first member 210 to be rotated in the direction B so that the second hooks 221 downwardly slide along the guide cams 215. As a result, the second member 220 is moved downwardly due to a self-weight. Meanwhile, as shown in FIG. 8, the second cam parts 225 of the second member 220 are brought into contact with the first cam parts 216 of the first member 210 and thereby are downwardly pressed. Accordingly, the second member 220 is further moved in the direction D and, thus its lowest surface contact-presses the upper portion of the dust-collector 130, thereby securely locking the dust-collector 130 to the cleaner body 110.

As described above, the dust-collector locking/unlocking device 200 according to the present invention is able to lock or unlock the dust-collector 130 with respect to the cleaner body 110 by simply rotating the manipulation lever 214 in one direction. Therefore, no extra tool is required and the dust-collector 130 is easily removed from the cleaner body 110.

Also, since the dust-collector locking/unlocking device 200 has a simplified structure integrating the first and the second members 210, 220, the dust-collector 130 is simply mounted or removed from the cleaner body 110. The simplified structure reduces the number of parts and simplifies an assembling process, which results in a cont-saving effect.

Also, since the dust-collector locking/unlocking device 200 is disposed on the upper portion of the dust-collector 130, there is no limitation in forming the suction passage and the discharging passage in the dust-collector 130. Also, the second member 220 of the dust-collector locking/unlocking device 200 serves as a cover to cover the dust-collector 130, an extra cover is not required. Accordingly, the volume of the dust-collector 130 can be reduced and thus the vacuum cleaner can be compact-sized.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A dust-collector locking/unlocking device to lock or unlock a dust-collector removably mounted in a cleaner body, the device comprising:

a first member having a first hook that is rotatably connected with the cleaner body and a manipulation lever that protrudes from an outer circumference of the first member, the first member being rotatable with respect to the cleaner body via the manipulation lever by a user; and a second member disposed under the first member, the second member having a second hook movably connected with guide cams formed on the first member, wherein the second member is a cover of the dust-collector and wherein the first member further comprises first cam parts formed on a lower surface of the first member, and the second member further comprises second cam parts having a shape to be engaged with the first cam parts, wherein the second member further comprises a fixing protrusion that is connected with the cleaner body and movable up and down, and wherein the first member further comprises a first penetrating hole and a second penetrating hole through which the second hook and the fixing protrusion of the second member penetrate, respectively.

2. A dust-collector locking/unlocking device to lock or unlock a dust-collector removably mounted in a cleaner body, the device comprising:

a lever member rotatably connected with the cleaner body; and a dust-collector cover moving up and down in cooperation with the rotational movement of the lever member, wherein the lever member further comprises first cam parts formed on a lower surface thereof and the dust-collector cover further comprises second cam parts on an upper surface thereof, the second cam parts having a shape to be engaged with the first cam parts, wherein the dust-collector cover further comprises a fixing protrusion that is connected with the cleaner body and movable up and down and a second hook movably connected with guide cams formed on the lever member, and wherein the lever member further comprises a first penetrating hole and a second penetrating hole through which the second hook and the fixing protrusion of the dust-collector cover penetrate, respectively.

3. The dust-collector locking/unlocking device as claimed in claim 2, wherein the dust-collector cover is hook-connected with guide cams formed on the lever member and moves up and down.

4. An upright vacuum cleaner comprising:

a cleaner body having a motor driving chamber;

a suction nozzle connected with a lower portion of the cleaner body;

a dust-collector removably mounted in the cleaner body; and a dust-collector locking/unlocking device to lock or unlock the dust-collector with respect to the cleaner body, the dust-collector locking/unlocking device comprising a first member rotatably connected with the cleaner body and having a manipulation lever, and a second member movably connected with a lower portion of the first member, wherein the second member moves up and down in cooperation with a cam movement of the first member when the manipulation lever is rotated, thereby locking or unlocking the dust-collector, and the second cover is a cover of the dust-collector, wherein the first member comprises a first hook connected with an upper wall of the cleaner body, and first cam parts formed on a lower end of the first member, wherein the second member comprises a second hook movably connected with guide cams formed on the first member, second cam parts engaged with the first cam parts, and a fixing protrusion connected with the upper wall of the cleaner body and movable vertically, and wherein the first member further comprises a first penetrating hole and a second penetrating hole through which the second hook and the fixing protrusion of the second member penetrate, respectively.

* * * * *